US005212056A

United States Patent [19]

Beltramini et al.

[11] Patent Number: 5,212,056

[45] Date of Patent: May 18, 1993

[54] SILVER HALIDE MULTILAYER COLOR PHOTOGRAPHIC ELEMENT COMPRISING A DISULFIDE SUPERSENSITIZER

[75] Inventors: Walter Beltramini, Albissola Superiore; Ivano Delprato, Rocchetta Di Cairo Montenotte, both of Italy

[73] Assignee: Minnesota Mining and Manufacturing Company, St. Paul, Minn.

[21] Appl. No.: 858,308

[22] Filed: Mar. 25, 1992

[30] Foreign Application Priority Data

Apr. 3, 1991 [IT] Italy ..... MI91 A 000924

[51] Int. Cl.[5] ..... G03C 1/09; G03C 1/12

[52] U.S. Cl. ..... 430/572; 430/503; 430/505; 430/556; 430/581; 430/583; 430/609; 430/611; 430/629

[58] Field of Search ..... 430/572, 611, 556, 583, 430/505, 503, 581, 609, 629

[56] References Cited

U.S. PATENT DOCUMENTS

| | | | |
|---|---|---|---|
| 3,954,478 | 5/1976 | Arai et al. | 430/550 |
| 4,374,196 | 2/1983 | Herz | 430/505 |
| 4,423,140 | 12/1983 | Herz | 430/445 |
| 4,780,400 | 10/1988 | Beltramini et al. | 430/505 |

FOREIGN PATENT DOCUMENTS 867355 9/1938 Fed. Rep. of Germany .

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

A multilayer silver halide color photographic element comprising at least one blue-sensitive silver halide emulsion layer comprising a blue spectral sensitizing dye and a supersensitizing amount of a disulfide compound of formula

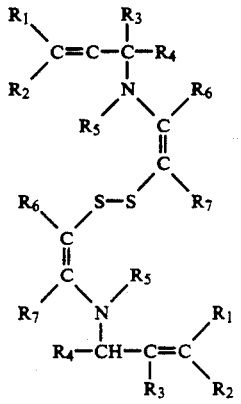

wherein $R_1$, $R_2$, $R_3$ and $R_4$, equal or different, each represents a hydrogen atom or a lower alkyl group, $R_5$ represents a hydrogen atom, a formyl group or an acetyl group, $R_6$ and $R_7$, equal or different, each represents a hydrogen atom or a lower alkyl group, or $R_6$ and $R_7$ represent the elements needed to complete an unsaturated cyclic nucleus.

The combination provides a blue-sensitive silver halide emulsion layer having high sensitivity, low fog and good resistance against fading of the latent image.

11 Claims, No Drawings

SILVER HALIDE MULTILAYER COLOR PHOTOGRAPHIC ELEMENT COMPRISING A DISULFIDE SUPERSENSITIZER

FIELD OF THE INVENTION

The present invention relates to silver halide multilayer color photographic elements and, more particularly, to silver halide multilayer color photographic elements comprising a blue sensitized silver halide emulsion layer containing a supersensitizing amount of a disulfide compound.

BACKGROUND OF THE INVENTION

Silver halide multilayer color photographic elements usually comprise, coated on a support, three silver halide dye-forming units or layers sensitive to blue, green and red light respectively associated with yellow, magenta and cyan dye-forming couplers. Preferably the elements comprise non-diffusible couplers which are incorporated in each of the light sensitive layers. These elements additionally comprise other non-light sensitive layers, such as intermediate layers, filter layers, antihalation layers and protective layers, thus forming a multilayered structure. These color photographic elements, after imagewise exposure to actinic radiation, are processed in a chromogenic developer to yield a visible color image.

Generally, with respect to the blue light sensitive layer, the inherently blue light sensitive region of the silver halides is normally utilized as it is. There may be the need, however, of increasing the absorption of light of given wavelenghths within the sensitivity spectrum of the emulsion, in order to enhance the record of the corresponding color and improve the response of the film in terms of color purity. To solve this problem, the blue-sensitive emulsion layer may be spectrally sensitized with the addition of spectral sensitizing dyes to impart thereto an absorption characteristic in a different, usually longer, wavelength region. However, the addition of spectral sensitizing dyes to a blue-sensitive silver halide emulsion may have the negative effect of decreasing the overall sensitivity of the emulsion to blue light.

Another problem often related to a blue-sensitive silver halide emulsion is the fading of the latent image. The latent image in a silver halide emulsion consists of minute specks of metallic silver formed in the interior or on the surface of individual silver halide grains upon exposure to actinic radiation. Development of exposed silver halide elements will selectively reduce to metallic silver those silver halide grains containing a latent image speck above a threshold size. It is known that a latent image is not permanent and, over a period of time, it fades with a consequent loss in image density and speed.

Among the latent image stabilizers for silver halide emulsions known in the art are N-alkenyl benzothiazolium and naphthothiazolium salts described in U.S. Pat. No. 3,954,478 and previously known as antifoggants in DE Pat. No. 867,355, compounds obtained by alkaline hydrolysis of said salts described in U.S. Pat. No. 4,423,140, compounds obtained by hydrolysis of certain thiazolium salts described in U.S. Pat. No. 4,374,196 and 2-unsubstituted N-alkenyl thiazolium salts described in U.S. Pat. No. 4,780,400. Problems are encountered with the use of these types of image stabilizers in blue-sensitive layers containing spectrally sensitized silver halide emulsions. These problems relate to a reduction of sensitivity. There is, therefore, the need to provide compounds or combination of compounds which give high sensitivity and good latent image stabilization to blue light sensitive layers as well as to other sensitive silver halide photographic emulsion layers.

SUMMARY OF THE INVENTION

It has now been found that, in a multilayer silver halide color photographic element, the combination in a blue-sensitive silver halide emulsion layer of a blue sensitizing dye and a disulfide compound of formula I

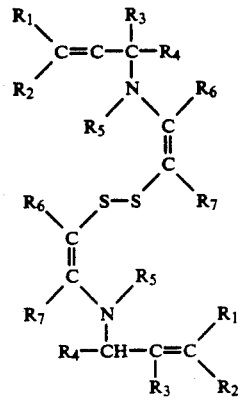

(I)

wherein $R_1$, $R_2$, $R_3$, and $R_4$, equal or different, each represents a hydrogen atom or a lower alkyl group, $R_5$ represents a hydrogen atom, a formyl group or a acetyl group, $R_6$ and $R_7$, equal or different, each represents a hydrogen atom or a lower alkyl group, or $R_6$ and $R_7$ represent the elements needed to complete an unsaturated (e.g., aromatic, phenyl) cyclic nucleus, has the effect of increasing the sensitivity and reducing the latent image fading of the spectrally sensitized blue-sensitive layer.

DETAILED DESCRIPTION OF THE INVENTION

Accordingly, the present invention relates to a multilayer silver halide color photographic element comprising a support base having coated thereon a yellow dye image-forming unit containing at least one blue-sensitive silver halide emulsion layer associated with yellow dye-forming couplers, a magenta dye image-forming unit containing at least one green-sensitive silver halide emulsion layer associated with magenta dye-forming couplers and a cyan dye image-forming unit containing at least one red-sensitive silver halide emulsion layer associated with cyan dye-forming couplers, wherein at least one blue-sensitive silver halide emulsion layer comprises a blue spectral sensitizing dye and a supersensitizing amount of the above described compound of formula I.

The term "dye image-forming unit", as used in the present invention, means one or more layers within a single photographic element, said one or more layers each being spectrally sensitized to a region of the electromagnetic spectrum and each containing a color coupler. Any layers included within a "unit" have similar or same regions of spectral sensitivity and form the same or similar dyes from their respective color couplers upon reaction with an oxidized color photographic developer.

In the above formula I, lower alkyl groups represented by $R_1$, $R_2$, $R_3$, $R_4$, $R_6$ and $R_7$ have from 1 to 5 carbon atoms; suitable lower alkyl groups are a methyl group, an ethyl group, a propyl group, an iso-propyl group, a butyl group, an iso-butyl group, a tertiary-buty 1 group, a normal pentyl group or a tertiary amyl group. The total carbon atoms of the lower alkyl groups represented by $R_1$, $R_2$, $R_3$, $R_4$, $R_6$ and $R_7$, when more than one group is present, is such not to negatively affect the supersensitizing properties of the compound I of this invention. The lower alkyl groups represented by $R_1$, $R_2$, $R_3$, $R_4$, $R_6$ and $R_7$ may have up to a maximum of 20 carbon atoms. Preferably, said total number of carbon atoms of $R_1$, $R_2$, $R_3$, $R_4$, $R_6$ and $R_7$ is less than 15, more preferably less than 5. The alkyl groups include substituted and unsubstituted groups. Useful substituents include halogen, cyano, aryl, carboxy, alkylcarbonyl, arylcarbonyl, alkoxycarbonyl, aryloxycarbonyl, and aminocarbonyl.

In the above formula I, $R_6$ and $R_7$ may represent the atoms needed to complete an unsaturated cyclic group such as an aryl group (e.g. phenyl, naphthyl) and include substituted and unsubstituted groups. Useful substituents include those listed above.

Typical examples of compounds according to the present invention include the following.

(1)

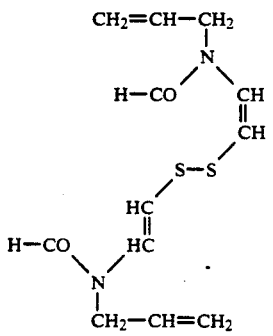

(2)

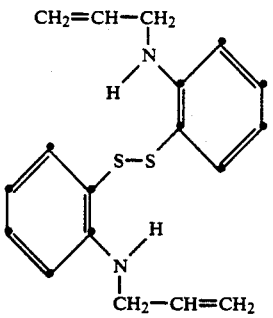

(3)

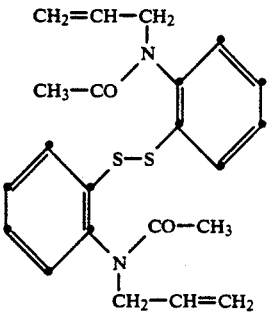

The blue spectral sensitizing dyes for use in the present invention include dyes that exhibit absorption maxima in the blue portion of the visible spectrum. Said dyes comprise sensitizing dyes from a variety of classes, including cyanines, merocyanines, oxonols, hemioxonols, styryls, merostyryls, and streptocyanines, and preferably from monomethine cyanines.

The preferred monomethine cyanine spectral sensitizing dyes for use in the blue-sensitive silver halide emulsion layers according to this invention include, joined by a methine linkage, two basic heterocyclic nuclei, such as those derived from quinolinium, pyridinium, isoquinolinium, 3H-indolium. benzindolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrilium and imidazopyrilium quaternary salts. Preferably monomethine cyanine spectral sensitizing dyes for use in the blue-sensitive silver halide emulsion layers according to this invention are those which exhibit J aggregates if adsorbed on the surface of the silver halide grains and a sharp absorption band (J-band) with a bathocromic shifting with respect to the absorption maximum of the free dye in aqueous solution. Spectral sensitizing dyes producing J aggregates are well known in the art, as illustrated by F. M. Hamer, *Cyanine Dyes and Related Compounds.* John Wiley and Sons, 1964, Chapter XVII and by T. H. James, *The Theory of the Photographic Process,* 4th edition, Macmillan, 1977, Chapter 8. The heterocyclic nuclei of the monomethine cyanine dyes preferably include fused benzene rings to enhance J aggregation.

The monomethine cyanine dyes used in the present invention can be represented by the following general formula (II):

(II)

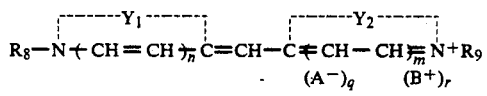

wherein $Y_1$ and $Y_2$ may be the same or different and each represents the elements necessary to complete a cyclic nucleus derived from basic heterocyclic nitrogen compounds such as oxazoline, oxazole, benzoxazole, the naphthoxazoles (e.g., naphth{2,1-d}oxazole, naphth{2,3-d}oxazole, and naphth{1,2-d}oxazole), thiazoline, thiazole, benzothiazole, the naphthothiazoles (e.g., naphtho{2,1-d}-thiazole), the thiazoloquinolines (e.g., thiazolo{4,5-b}-quinoline), selenazoline, selenazole, benzoselenazole, the naphthoselenazoles (e.g., naphtho{1,2-d}selenazole, 3H-indole (e.g., 3,3-dimethyl-3H-indole), the benzindoles (e.g., 1,1-dimethylbenzindole), imidazoline, imidazole, benzimidazole, the naphthimidazoles (e.g., naphth{2,3-d}-imidazole), pyridine, and quinoline, which nuclei may be substituted on the ring by one or more of a wide variety of substituents such as hydroxy, the halogens (e.g., fluoro, bromo, chloro, and iodo), alkyl groups or substituted alkyl groups (e.g., methyl, ethyl, propyl, isopropyl, butyl, octyl, dodecyl, 2-hydroxyethyl, 3-sulfopropyl, carboxymethyl, 2-cyanoethyl, and trifluoromethyl), aryl groups or substituted aryl groups e.g., phenyl, 1-naphthyl, 2-naphthyl, 4-sulfophenyl, 3-carboxyphenyl, and 4-biphenyl , aralkyl groups (e.g., benzyl and phenethyl), alkoxy groups e.g., methoxy, ethoxy, and isopropoxy), aryloxy groups e.g., phenoxy and 1-naphthoxy), alkylthio groups (e.g., ethylthio and methylthio), arylthio groups (e.g., phenylthio, p-tolythio, and 2-naphthylthio), methylenedioxy, cyano, 2-thienyl, styryl, amino or substituted amino groups (e.g., anilino, dimethylanilino, diethylanilino, and morpholino), acyl groups (e.g., acetyl and benzoyl), and sulfo groups, $R_8$ and $R_9$ can be the same or different and represent alkyl groups (including alkenyl and alkinyl groups), aryl groups or aralkyl groups, with or without substituents, (e.g., carboxymethyl, 2-hydroxyethyl, 3-sulfopropyl, 3-sulfobutyl, 4-sulfobutyl, 2-methoxyethyl, 2-sulfatoethyl, 3-thiosulfatoethyl, 2-phosphonoethyl, chlorophenyl, and bromophenyl), n and m are 0 or 1, except that both n and m preferably are not 1, A is an anionic group, B is a cationic group, and q and r may be 0 or 1, depending on whether ionic substituents are present. Variants are, of course, possible in which $R_8$ and $R_9$ (particularly when n and m are 0) together represent the atoms necessary to complete an alkylene bridge.

In the most preferred form of this invention, the monomethine cyanine dyes used in the present invention are represented by the following general formula (III):

(III)

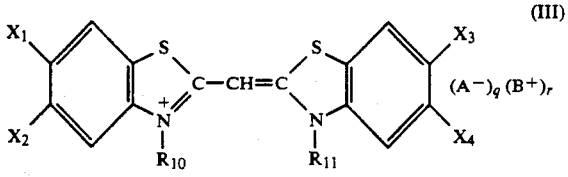

wherein $X_1$, $X_2$, $X_3$ and $X_4$ each represents a hydrogen atom, a halogen atom (e.g. chloro, bromo, iodo, and fluoro), a hydroxy group, an alkoxy group (e.g. methoxy and ethoxy), an amino group (e.g. amino, methylamino, and dimethylamino), an acylamino group (e.g. acetamido and propionamido), an acyloxy group (e.g. acetoxy group), an alkoxycarbonyl group (e.g. methoxycarbonyl, ethoxycarbonyl, and butoxycarbonyl), an alkyl group (e.g. methyl, ethyl, and isopropyl), an alkoxycarbonylamino group (e.g. ethoxycarbonylamino) or an aryl group (e.g. phenyl and tolyl), or, together, $X_1$ and $X_2$ and, respectively, $X_3$ and $X_4$ can be the atoms necessary to complete a benzene ring (so that the heterocyclic nucleus results to be, for example, an α-naphthoxazole nucleus, a β-naphthoxazole or a β,β'-naphthoxazole), $R_{10}$ and $R_{11}$ each represents an alkyl group (e.g. methyl, propyl, and butyl), a hydroxyalkyl group (e.g. 2-hydroxyethyl, 3-hydroxypropyl, and 4-hydroxybutyl), an acetoxyalkyl group (e.g. 2-acetoxyethyl and 4-acetoxybutyl), an alkoxyalkyl group (e.g. 2-methoxyethyl and 3-methoxypropyl), a carboxyl group containing alkyl group (e.g. carboxymethyl, 2-carboxyethyl, 4-carboxybutyl, and 2-(2-carboxyethoxy)-ethyl), a sulfo group containing alkyl group (e.g. 2-sulfoethyl, 3-sulfopropyl, 4- sulfobutyl, 2-hydroxy3- sulfopropyl, 2-(3-sulfopropoxy)-propyl, p-sulfobenzyl, and p-sulfophenethyl), a benzyl group, a phenetyl group, a vinylmethyl group, and the like, A, B, q and r have the same meaning as above.

The alkyl groups included in said substituents $X_1X_1$, $X_2$, $X_3$, $X_4$, $R_{10}$, and $R_{11}$ and, more particularly, the alkyl portions of said alkoxy, alkoxycarbonyl, alkoxycarbonylamino, hydroxyalkyl, acetoxyalkyl groups and of the alkyl groups associated with a carboxy or sulfo group each preferably contain from 1 to 12, more preferably from 1 to 4 carbon atoms, the total number of carbon atoms included in said groups preferably being no more than 20.

The aryl groups included in said substituents $X_1X_1$, $X_2$, $X_3$ and $X_4$ each preferably contain from 6 to 18, more preferably from 6 to 10 carbon atoms, the total number of carbon atoms included in said groups arriving up to 20 carbon atoms.

The following are specific examples of monomethine cyanine spectral sensitizing dyes belonging to those represented by the general formulas (II) and (III) above:

1.

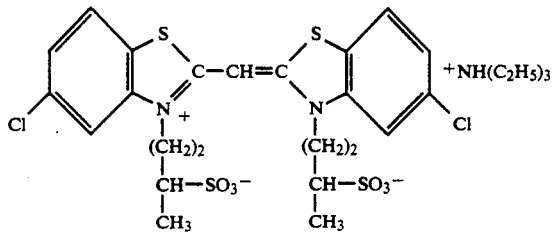

2.

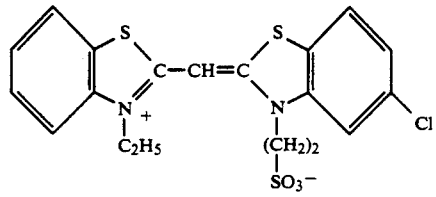

3.

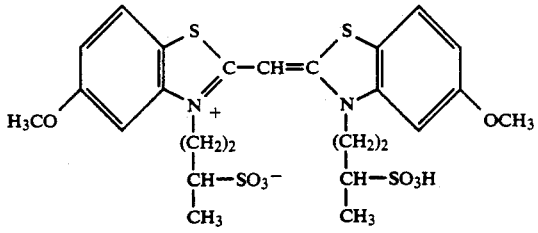

4.

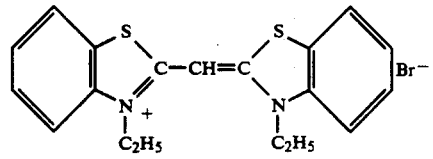

5.

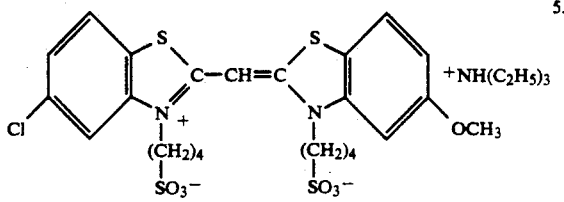

-continued

6.

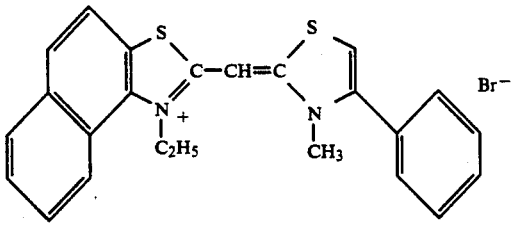

7.

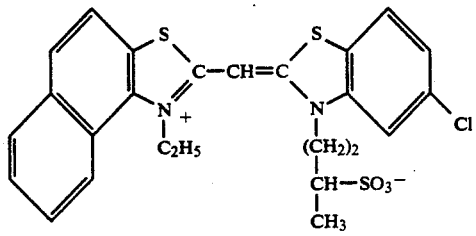

8.

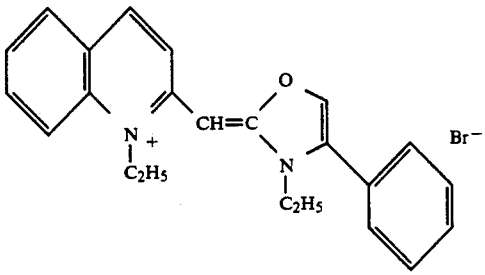

The blue spectral sensitizing dyes and the compounds of formula I may be incorporated in any blue-sensitive silver halide emulsion layer of the multilayer color silver halide element according to the present invention. They may be incorporated into any blue-sensitive silver halide emulsion layer during any step of the preparation of the photographic material. They may be added during the emulsion making, the physical ripening, before or after the chemical ripening and before or during the coating process, as known in the art. The blue spectral sensitizing dyes extend the spectral sensitivity of the silver halide emulsion in the spectral range of from 440 to 480 nm and are preferably incorporated in an amount of from 10 to 1,000 micromoles per mole of silver halide. If said blue spectral sensitizing dyes are incorporated in an amount within said range, an increase in spectral sensitivity occurs in the above wavelength range with a sharp J band at about 465 nm, with concurrently a decrease of the overall sensitivity to blue light. The compounds of formula I do not modify the spectral absorption of the blue-sensitive silver halide emulsion layers into which they are incorporated, but surprisingly improve the overall blue sensitivity. The combination of said blue spectral sensitizing dyes and said compounds of formula I results in an improvement of blue sensitivity which cannot be obtained with the single components of the combination used separately. Said compounds of formula I are preferably incorporated in an amount of from 0.1 to 10 micromoles per mole of silver halide.

The multilayer color photographic elements of the present invention are preferably multilayer color silver photographic elements comprising a blue sensitized silver halide emulsion layer associated with yellow dye-forming color couplers, a green sensitized silver halide emulsion layer associated with magenta dye-forming color couplers and a red sensitized silver halide emulsion layer associated with cyan dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

In order to disperse the couplers into the silver halide emulsion layer, conventional coupler in oil dispersion methods well-known to the skilled in the art can be employed. Said methods, described for example in U.S. Pat. Nos. 2,322,027; 2,801,170; 2,801,171 and 2,991,177, consist of dissolving the coupler in a water-immiscible high boiling organic solvent (the "oil") and then mechanically dispersing such a solution in a hydrophilic colloidal binder under the form of small droplets having average sizes in the range from 0.1 to 1, preferably from 0.15 to 0.3 $\mu$m. The preferred colloidal binder is gelatin, even if other kinds of binders can also be used.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an $\alpha$-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in the present invention include both those substantially colorless and those which are colored ("masked couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383;

2,895,826; 3,458,315; 3,311,476; 3,419,390; 3,476,563 and 3,253,924; and in British patent 1,201,110.

Examples of magenta couplers which can be used in the present invention can be selected from those described in U.S. Pat. Nos. 2,600,788; 3,558,319; 3,468,666; 3,419,301; 3,311,476; 3,253,924 and 3,311,476 and in British patents 1,293,640; 1,438,459 and 1,464,361.

Examples of yellow couplers which can be used in the present invention can be selected form those described in U.S. Pat. Nos. 3,265,506, 3,278,658, 3,369,859, 3,528,322, 3,408,194, 3,415,652 and 3,235,924, in German patent applications 1,956,281, 2,162,899 and 2,213,461 and in British Patents 1,286,411, 1,040,710, 1,302,398, 1,204,680 and 1,421,123.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British patent 1,464,361.

Colorless couplers which can be used in the present invention can be selected from those described in British patents 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent applications S.N. 2,414,006; 2,659,417; 2,527,652; 2,703,145 and 2,626,315; in Japanese patent applications S.N. 30,591/75 and 82,423/77 and in British patent 1,153,587.

Examples of non-color forming DIR coupling compounds which can be used in the present invention include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75 and in British patents 1,423,588 and 1,542,705.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethyl-cellulose, etc., a synthetic resin, such as polyvinyl alcohol, polyvinylpyrrolidone, polyacrylamide, etc. Preferred silver halides are silver iodo-bromide or silver iodo-bromo-chloride containing 1 to 12% mole silver iodide. The silver halide grains may have any crystal form such as cubical, octahedral, tabular or a mixed crystal form. The silver halide can have a uniform grain size or a broad grain size distribution. The size of the silver halide ranges from about 0.1 to about 5 $\mu$m. The silver halide emulsion can be prepared using a single-jet method, a double-jet method, or a combination of these methods or can be matured using, for instance, an ammonia method, a neutralization method, an acid method, etc. The emulsions which can be used in the present invention can be chemically and optically sensitized as described in Research Disclosure 17643, III and IV, December, 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December, 1978. The layers of the photographic emulsion and the layers of the photographic material can contain various colloids, alone or in combination, such as binding materials, as for instance described in Research Disclosure 17643, IX, December, 1978. The above described emulsions can be coated onto several support bases (cellulose triacetate, paper, resin-coated paper, polyester included) by adopting various methods, as described in Research Disclosure 17643, XV and XVII, December, 1978. The light-sensitive silver halide contained in the photographic materials of the present invention after exposure can be processed to form a visible image by associating the silver halide with an aqueous alkaline medium in the presence of a developing agent contained in the medium or in the material. Processing formulations and techniques are described in Research Disclosure 17643, XIX, XX and XXI, December, 1978.

The following examples are described for a better understanding of this invention.

PREPARATIVE EXAMPLE 1

Bis-(N-formyl-N-allylamino-vinylene) disulfide (Compound 1)

An aqueous solution of N-allylthiazolium bromide (38 g, 0.188 mole) in 40 ml of water was added with stirring with NaOH N (45 ml). $H_2O_2$ 3% by weight (60 ml) was added to the resulting solution at room temperature and the mixture was stirred for 2 hours. The disulfide was purified with column chromatography (silica gel, ethylacetate:eptane 1:1 as a yellow oil (yield 14.5 g).

| Empirical formula: $C_{12}H_{16}N_2S_2O_2$ | | | | |
|---|---|---|---|---|
| | C% | H% | S% | N% |
| Calculated | 50.68 | 5.67 | 22.55 | 9.85 |
| Found | 51.28 | 5.78 | 21.65 | 9.50 |

PREPARATIVE EXAMPLE 2

Bis-[2-(N-allylamino)phenyl] disulfide (Compound 2)

$NH_4OH$ (28° Bé, 100 ml) was added to N-allylbenzothiazolium bromide (10 g, 0.04 mole) in ethanol (100 ml). The resulting solution was held four days at room temperature, then poured into cold water (500 ml) and extracted twice with ethyl ether (2×100 ml). The organic solution was dried over anhydrous $Na_2SO_4$, then evaporated to dryness. The oily residue was purified by column chromatography silica gel, eptane:$CH_2Cl_2$ 1:1) to give the product (yield 5 g).

| Empirical formula: $C_{18}H_{20}N_2S_2$ | | | | |
|---|---|---|---|---|
| | C% | H% | S% | N% |
| Calculated | 65.81 | 6.14 | 19.52 | 8.53 |
| Found | 66.06 | 6.09 | 19.36 | 8.50 |

PREPARATIVE EXAMPLE 3

Bis-[2-(N-acetyl-N-allylamino)phenyl] disulfide (Compound 3)

This compound was prepared as in preparative example 2 starting from N-allyl-2-methylbenzohiazolium bromide, obtaining a yellow oil (yield 5.5 g).

| | Empirical formula: $C_{22}H_{24}N_2S_2O_2$ | | | |
|---|---|---|---|---|
| | C% | H% | S% | N% |
| Calculated | 64.05 | 5.86 | 15.54 | 6.79 |
| Found | 64.10 | 5.82 | 15.50 | 6.77 |

EXAMPLE 4

A blue-sensitive silver halide unit (Film A; comparative example) formed of layers having the following composition coated on a subbed cellulose triacetate base was prepared.

First layer: Yellow filter layer. A gelatin layer comprising dispersed particles of yellow colloidal silver.

Second layer: Blue-sensitive low sensitivity layer. A gelatin layer comprising a blend of AgBrI emulsions (60% by weight of a low speed AgBrI emulsion having 97.5% by mole of Br- , 2.5% by weight of I- and 0.31 μm average grain size, and 40% by weight of a medium speed AgBrCII emulsion having 88% by mole of Br-, 7% by mole of I-, 5% by mole of Cl- and 0.43 μm average grain size), chemically sensitized with gold and thiosulfate and stabilized with 4-methyl-6-hydroxy-tetraazaindene, at a silver coating weight of 1 g/m$^2$ and a silver/gelatin ratio of 1.2, Coupler A in an amount of 0.286 mole per mole of silver.

Third layer: Blue-sensitive high sensitivity layer. A gelatin layer comprising a AgBrI emulsion (having 88% by mole of Br- 12% by weight of I- and 1.03 μm average grain size), chemically sensitized with gold and thiosulfate and stabilized with 4-methyl-6-hydroxy-tetraazaindene, at a silver coating weight of 0.5 g/m$^2$ and a silver/gelatin ratio of 1.2, Coupler A in an amount of 0.13 mole per mole of silver.

A second film (Film B: comparative example) was obtained in the same manner of the previous film A, except that the second and the third layers comprised the monomethine cyanine Dye 1 in an amount, respectively, of 200 and 150 micromoles per mole of silver.

A third film (Film C: comparative example) was obtained in the same manner of the previous film A, except that the second and the third layers comprised the disulfide compound 1 in an amount, respectively, of 2 and 0.5 micromoles per mole of silver.

A fourth film (Film D: example of the invention) was obtained in the same manner of the previous film A, except that the second and the third layers comprised the monomethine cyanine Dye 1 in an amount, respectively, of 200 and 150 micromoles per mole of silver, and the disulfide compound 1 in an amount, respectively, of 2 and 0.5 micromoles per mole of silver.

A fifth film (Film E: comparative example) was obtained in the same manner of the previous film A, except that the second and the third layers comprised the monomethine cyanine Dye 1 in an amount, respectively, of 200 and 150 micromoles per mole of silver, and benzo-(1,2-d:5,4-d')-bis-thiazole N-allylbromide described in U.S. Pat. No. 4,849,327 in an amount, respectively, of 2 and 0.5 micromoles per mole of silver.

Each film had a gelatin protective layer coated on top, containing a 1,3-dichloro-5-hydroxytriazine hardener.

A sample of each film was exposed to a light source having a color temperature of 5500° F. and developed in a C-41 process as described in British Journal of Photography, July, 1974, pages 597–598.

The sensitometric result (fog) and the speed (DIN numbers), measured at 0.20 above fog Speed 1) and at 1.00 above fog (Speed 2), are reported in the following Table 1.

TABLE 1

| Film | Fog | Speed 1 | Speed 2 |
|---|---|---|---|
| A (comparison) | 0.23 | 25.2 | 12.6 |
| B (comparison) | 0.15 | 24.7 | 12.8 |
| C (comparison) | 0.23 | 25.9 | 12.8 |
| D (invention) | 0.16 | 26.0 | 13.5 |
| E (comparison) | 0.13 | 24.3 | 12.5 |

From the figures of Table 1, film D shows enhanced values of sensitivity, while fog is favorably reduced or kept at a low level.

A sample (S1) of each film was exposed to a light source having a color temperature of 5500K and then stored for 30 days in a freezer.

Another sample (S2) of each film was exposed in the same way and then stored for 30 days at 24° C. and 50% RH.

A third sample (S3) of each film was stored in a freezer for 30 days before exposure; a fourth sample (S4) of each film was stored at 24° C. and 50% RH for 30 days before exposure.

After 30 days all samples were gathered, virgin samples exposed and all developed in C-41 processing. Table 2 shows the speed values Sp.1 and Sp.2 of all samples respectively read at an optical density of 0.20 and 1.00

TABLE 2

| | | Film | | | | |
|---|---|---|---|---|---|---|
| | | A(comp.) | B(comp.) | C(comp.) | D(inv.) | E(comp.) |
| | Fog | .21 | .15 | .21 | .15 | .13 |
| S1 | Sp.1 | 23.8 | 23.2 | 24.6 | 24.8 | 23.3 |
| | Sp.2 | 10.6 | 10.7 | 11.0 | 11.5 | 11.0 |
| | Fog | .22 | .15 | .21 | .16 | .13 |
| S2 | Sp.1 | 22.4 | 21.1 | 24.4 | 24.5 | 23.6 |
| | Sp.2 | 9.5 | 9.2 | 10.3 | 10.4 | 10.5 |
| | Fog | .21 | .15 | .21 | .16 | .13 |
| S3 | Sp.1 | 24.0 | 23.6 | 25.1 | 25.3 | 23.7 |
| | Sp.2 | 10.6 | 11.0 | 11.4 | 11.7 | 11.4 |
| | Fog | .21 | .15 | .21 | .16 | .13 |
| S4 | Sp.1 | 24.4 | 24.1 | 25.4 | 25.4 | 23.6 |
| | Sp.2 | 10.0 | 11.2 | 11.4 | 11.7 | 11.4 |

From the figures of Table 2 it is seen that there is poor stability of the emulsions without any addition; the addition of the blue-sensitizing dye alone does not allow any improvement but a lower fog; the addition of the disulfide compound alone allows a better latent image keeping but a relatively high fog level; and the proper combination of both the blue-sensitizing dye and the disulfide compound gives a good latent image stability at a reduced fog level.

Coupler A:

-continued

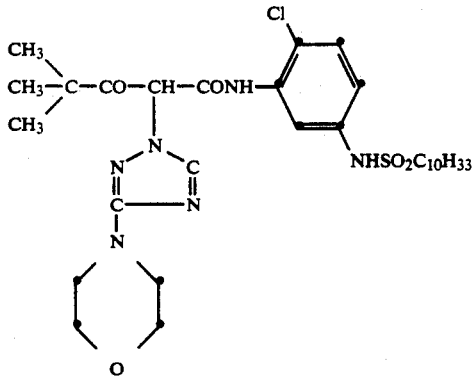

We claim:

1. A multilayer silver halide color photographic element comprising at least one blue-sensitive silver halide emulsion layer comprising a blue spectral sensitizing dye and a supersensitizing amount of a disulfide compound of formula (I)

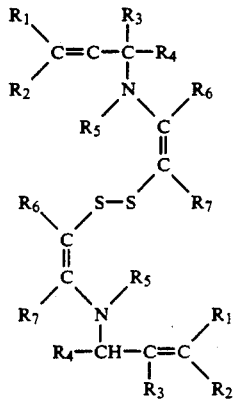

(I)

wherein $R_1$, $R_2$, $R_3$, and $R_4$, equal or different, each represents a hydrogen atom or a lower alkyl group, $R_5$ represents a hydrogen atom, a formyl group or a acetyl group, $R_6$ and $R_7$, the same or different, each represents a hydrogen atom or a lower alkyl group, or $R_6$ and $R_7$ represent the elements needed to complete an unsaturated cyclic nucleus.

2. A silver halide multilayer color photographic element as claimed in claim 1, wherein said blue sensitizing dye is represented by the general formula (II)

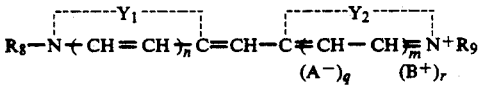

(II)

wherein $Y_1$ and $Y_2$, the same or different, represent the elements necessary to complete a basic 5- or 6-membered heterocYclic nucleus, $R_8$ and $R_9$, the same or different, represent alkyl groups, aryl groups or aralkyl groups, n and m are 0 or 1, A is an anionic group, B is a cationic group, and q and r are 0 or 1.

3. A silver halide multilayer color photographic element as claimed in claim 1, wherein said blue sensitizing dye is represented by the general formula (III)

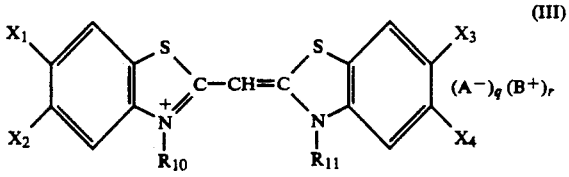

(III)

wherein $X_1$, $X_2$, $X_3$ and $X_4$ each represents a hydrogen atom, a halogen atom, a hydroxy group, an alkoxy group, an amino group, an acylamino group, an acyloxy group, an alkoxycarbonyl group, an alkyl group, an alkoxycarbonylamino group or an aryl group, or, together, $X_1$ and $X_2$ and, respectively, $X_3$ and $X_4$ can be the atoms necessary to complete a benzene ring, $R_{10}$ and $R_{11}$ each represents an alkyl group, a hydroxyalkyl group, an acetoxyalkyl group, an alkoxyalkyl group, a carboxyl group containing alkyl group, a sulfo group containing alkyl group, a benzyl group, a phenetyl group, or a vinylmethyl group, A is an anionic group, B is a cationic group, and q and r represent 0 or 1.

4. A silver halide multilayer color photographic element as claimed in claim 1, wherein said disulfide compound has the formula

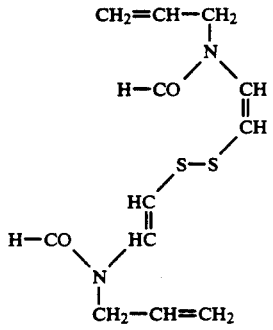

5. A silver halide multilayer color photographic element as claimed in claim 1, wherein each silver halide emulsion is a negative-acting emulsion.

6. A silver halide multilayer color photographic element as claimed in claim 1, wherein each silver halide emulsion is a silver bromoiodide emulsion.

7. A silver halide multilayer color photographic element as claimed in claim 1, wherein said blue sensitizing dye is present in the silver halide emulsion layer in an amount ranging from 10 to 1,000 micromoles per mole of silver.

8. A silver halide multilayer color photographic element as claimed in claim 1, wherein said disulfide compound is present in the silver halide emulsion layer in an amount ranging from 0.1 to 10 micromoles per mole of silver.

9. A silver halide multilayer color photographic element as claimed in claim 1, wherein said blue sensitive silver halide emulsion is associated with a yellow dye-forming coupler unit.

10. A silver halide multilayer color photographic element as claimed in claim 9, wherein said yellow dye-forming unit is comprised of a plurality of blue-sensitive silver halide layers of different sensitivity.

11. A silver halide multilayer color photographic element as claimed in claim 9, wherein said yellow dye-forming unit is comprised of a high sensitivity silver halide emulsion layer and a low sensitivity silver halide emulsion layer.

* * * * *

UNITED STATES PATENT AND TRADEMARK OFFICE

CERTIFICATE OF CORRECTION

PATENT NO. : 5,212,056

DATED : May 18, 1993

INVENTOR(S) : Walter Beltramini et al.

It is certified that error appears in the above-identified patent and that said Letters Patent is hereby corrected as shown below:

| | |
|---|---|
| Col. 3, lines 5-6 | "tertiary-buty l" should be -- tertiary-butyl -- |
| Col. 5, line 1 | "e.g., phenoxy" should be -- (e.g., phenoxy -- |
| Col. 12, line 39 | "1.00" should be -- 1.00 above fog. -- |

Signed and Sealed this

First Day of March, 1994

Bruce Lehman

BRUCE LEHMAN

*Commissioner of Patents and Trademarks*

*Attest:*

*Attesting Officer*